United States Patent [19]

Moehren

[11] Patent Number: 4,572,432

[45] Date of Patent: Feb. 25, 1986

[54] ANCHOR LOCK FASTENING ASSEMBLY

[76] Inventor: Hans-Heiner Moehren, 514 Holly Rd., Yeadon, Pa. 19050

[21] Appl. No.: 650,121

[22] Filed: Sep. 13, 1984

[51] Int. Cl.[4] ..... E01B 9/00; E01B 13/02

[52] U.S. Cl. ..... 238/327 R; 238/304; 238/307; 238/315

[58] Field of Search ..... 238/327 R, 327 A, 328, 238/315, 321, 299, 307, 287, 304, 349, 338

[56] References Cited

U.S. PATENT DOCUMENTS

| | | | |
|---|---|---|---|
| 1,206,836 | 12/1916 | Gillmor | 238/304 |
| 1,478,787 | 12/1923 | Hyle | 238/315 |
| 2,294,987 | 9/1942 | Johnson | 238/327 R |
| 2,626,108 | 1/1953 | Spencer | 238/327 R |
| 4,365,744 | 12/1982 | Moehren | 238/299 |

*Primary Examiner*—Robert B. Reeves
*Assistant Examiner*—Dennis C. Rodgers
*Attorney, Agent, or Firm*—Birch, Stewart, Kolasch & Birch

[57] ABSTRACT

A substantially load free anchor lock fastening assembly for fastening a floating rail to a railroad tie which comprises an anchor lock plate which is adapted to be attached to an existing railroad tie plate or rail support, the tie plate having a rail support central channel area and shoulder areas which extend in opposite directions from the rail support central channel area, at least one of the shoulder areas being provided with an anchor lock plate which extends beyond the side of the tie, and above the base of the rail, and a rail anchor of unitary construction containing a first portion adapted to wedge against the base of the rail and a second portion adapted to take leverage against the side of the tie, the rail anchor being overlapped by the anchor locks outside the base edge of the rail with a small gap being maintained between the anchor and the anchor lock whereby rail rotation and rail uplift are controlled without adding strain to that portion of the anchor which is in contact with the tie and longitudinal restraint is provided.

5 Claims, 6 Drawing Figures

ANCHOR LOCK FASTENING ASSEMBLY

BACKGROUND AND SUMMARY OF THE INVENTION

The present invention is directed to an anchor lock fastening assembly (ALFA) which provides the function of holding the rail to the railroad tie while at the same time preventing longitudinal displacement of the rail. More particularly, the present invention is directed in one embodiment to an anchor lock hook plate which readily adapts to an existing tie plate and which controls rail rotation and rail uplift without adding strain to that portion of the anchor which is in contact with the tie and also provides longitudinal restraint to the rail.

In prior art anchor locking devices, the anchor lock is welded to the existing tie plate which introduces an element of work with stringent quality control requirements. Based on the fact that the carbon content can vary greatly from one steel plate to the next, the field experience with welded rail fastening components has not been entirely satisfactory. Since fastenings are subjected to pulsating loads and vibrations in a wide range of frequencies, the fatigue strength of a weldment would be tested to the extreme. A riveted connection is feasible but is considered to expensive.

Accordingly, an object of the present invention is to provide an anchor lock that functions to restrain both righthand and lefthand rotation of the rail.

A further object of the present invention is to provide anchor locks which permit the utilization of existing tie plates to form an anchor lock assembly without modifying or welding the plate.

Still another object of the present invention is to provide a load free anchor lock assembly wherein the anchor lock hook plate is positioned by the existing plate holding spikes in cooperation with down holding hooks which are part of the anchor lock hook plate.

Still another object of the present invention is to provide an insulating member which is effective in providing electrical insulation between the railroad tie and the anchor and which also functions to occupy the space between the anchor and the base of the rail thereby preventing the accumulation of ice between the anchor and the base of the rail.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description. to the present invention, a positive lock for a floating rail has been developed as an attachment to an existing tie plate wherein the rail hold down forces are transmitted to the bottom surface of the tie plate by means of downholding hooks which are part of the anchor lock.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1A:
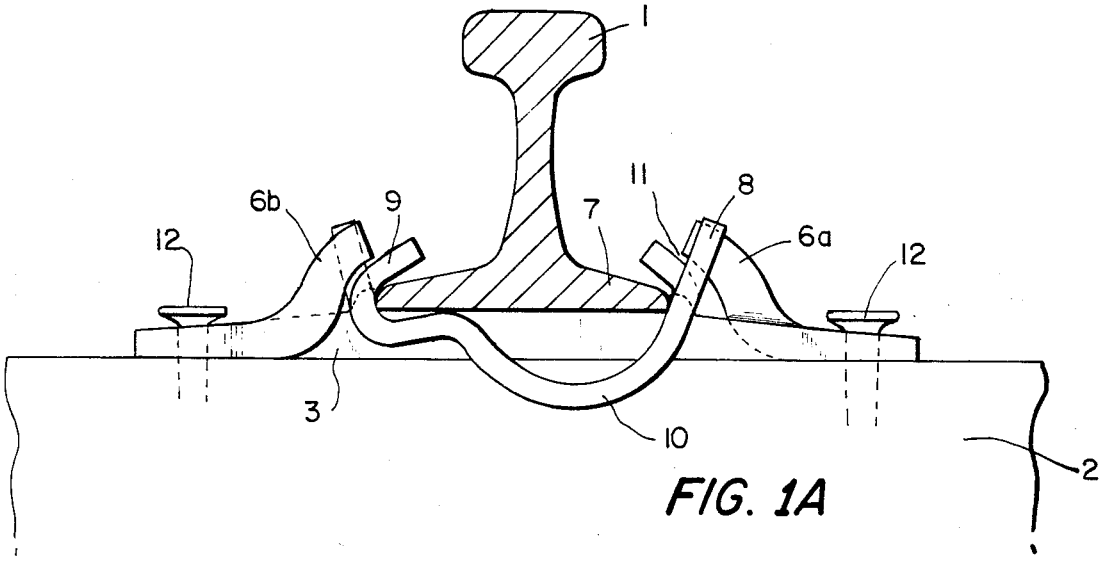
FIG. 1A shows a side view of the anchor lock fastening assembly.

The present invention will now be described, in detail, in connection with the drawings wherein like reference numerals are used throughout the various views to indicate like parts.

Figure 1B:
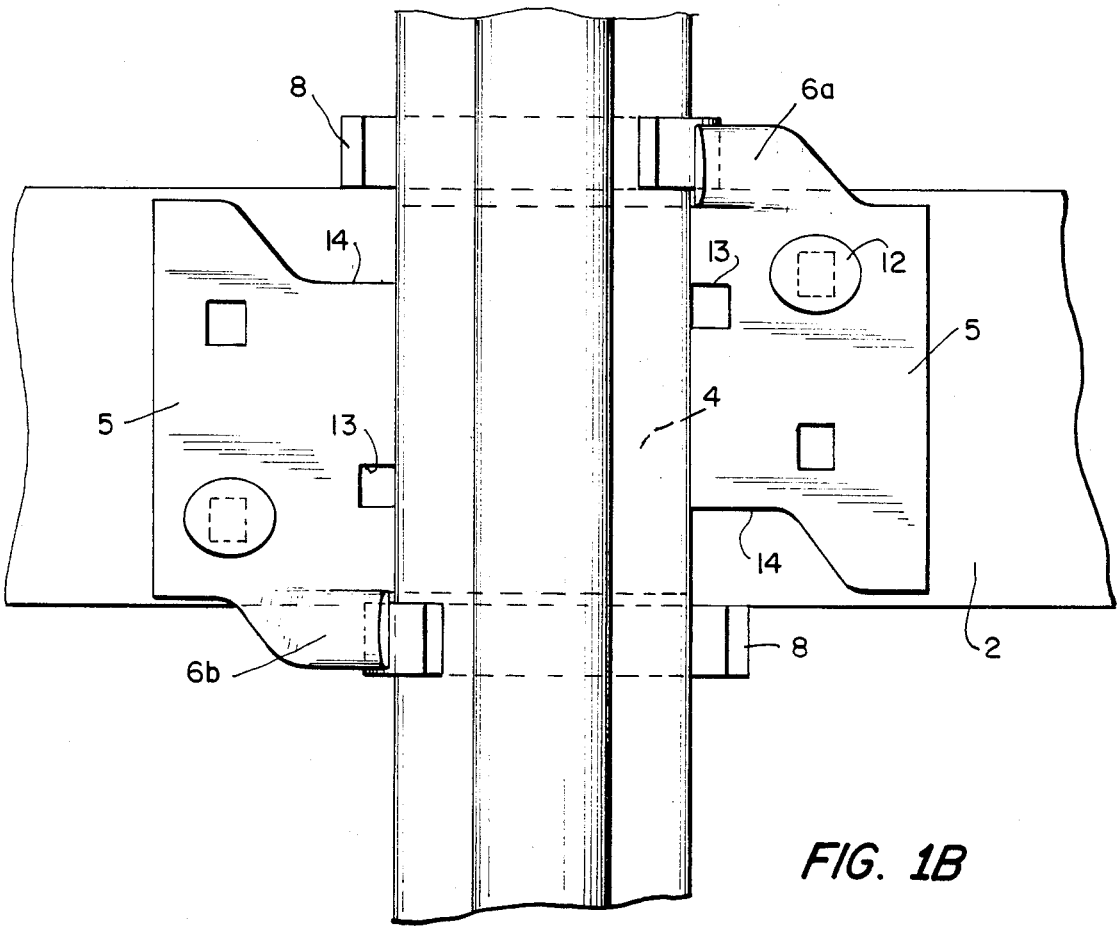
FIG. 1B shows a plane view of the anchor lock fastening assembly of FIG. 1A.

The anchor lock fastening assembly of the present invention as shown in FIGS. 1A and 1B comprises a floating rail 1 which is disposed in an anchor lock plate 3 which is adapted to be attached to a railroad tie or rail support 2. The anchor lock plate has a rail support central channel area 4 and shoulder areas 5 which extend in opposite directions from the rail support central channel area. At least one of the shoulder areas 5 is provided with an anchor lock *6a* or *6b* which extends beyond the side of the railroad tie 2 and above the base of the rail 7. A rail anchor 8 of unitary construction contains a first portion 9 adapted to wedge against the base of the rail and a second portion 10 adapted to take leverage against the side of the railroad tie. The wedge portion 9 of the rail anchor is overlapped by the anchor locks *6a* or *6b* outside the base edge of the rail with a small gap 11 being maintained between the anchor 8 and the anchor lock *6a* or *6b*, whereby rail rotation and rail uplift are controlled without adding strain to that portion of the anchor which is in contact with the tie. The anchor 8 provides longitudinal restraint under all load conditions.

As shown in the embodiment of FIGS. 1A and 1B, the anchor locks *6a* and *6b* are disposed asymmetrically with respect to the axis of the rail and on opposite sides of the railroad tie.

The anchor lock plate 3 can be secured to the railroad tie 2 by any known means such as hold down spikes 12 which extend through the shoulders 5. The shoulders of the anchor lock plate are also provided with standard rail spike holes 13 which can be used in locations where the presence of insulated joints impede the effective use of anchors.

According to the present invention, the anchor lock and the anchor lock plate can be of a unitary construction wherein the anchor lock plates are sheared out of a rolled section of steel with each plate containing cut out portions 14 which, in volume, correspond to the volume of the anchor lock forming portion *6a* and/or *6b* of an adjacent anchor lock plate. This particular construction achieves an effective use of materials since the total weight of the anchor lock plate is substantially identical to that of a standard tie plate of similar dimensions.

Figure 2:
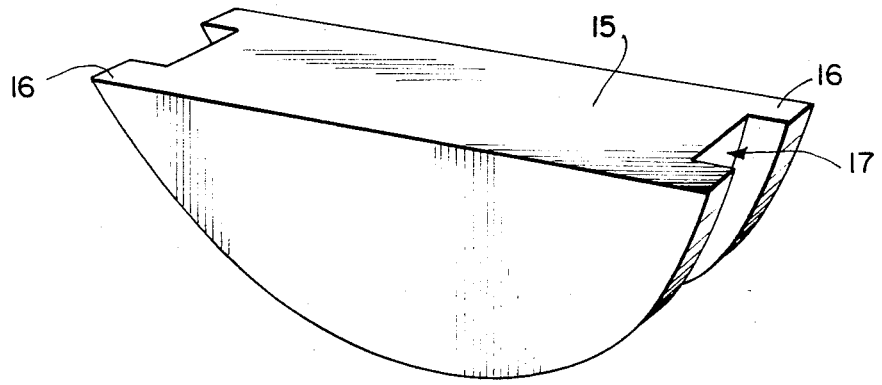
FIG. 2 shows in a perspective view, the insulating saddle which is utilized in combination with the anchor lock fastening assembly of FIG. 1A.

In another feature of the present invention, that portion of the rail anchor which extends below the rail is provided with an insulating saddle 15 which fills the space between the anchor 10 and the base of the rail 7 and provides an interface 16 between the anchor 8 and the tie 2 for electrically insulating the anchor from the tie and preventing the accumulation of ice between the anchor and the base of the rail. This is particularly true when it is desired to insulate a concrete railroad tie from steel components. Advantageously, the insulating saddle is made of a plastic material, such as for example, various nylons, polyurethanes, polyolefins and also any other type of electrically insulating materials such as rubbers or hardwoods. As shown in FIG. 2, the insulating saddle is provided with a groove 17 which facilitates the secure fastening of the insulating saddle to the anchor 8.

Although, as stated above, the anchor locks 6*a* and 6*b* are cut out of a rolled section, it is also possible to affix anchor locks to a standard tie plate to convert it to an anchor lock plate similar to that discussed hereinabove.

Figure 3:
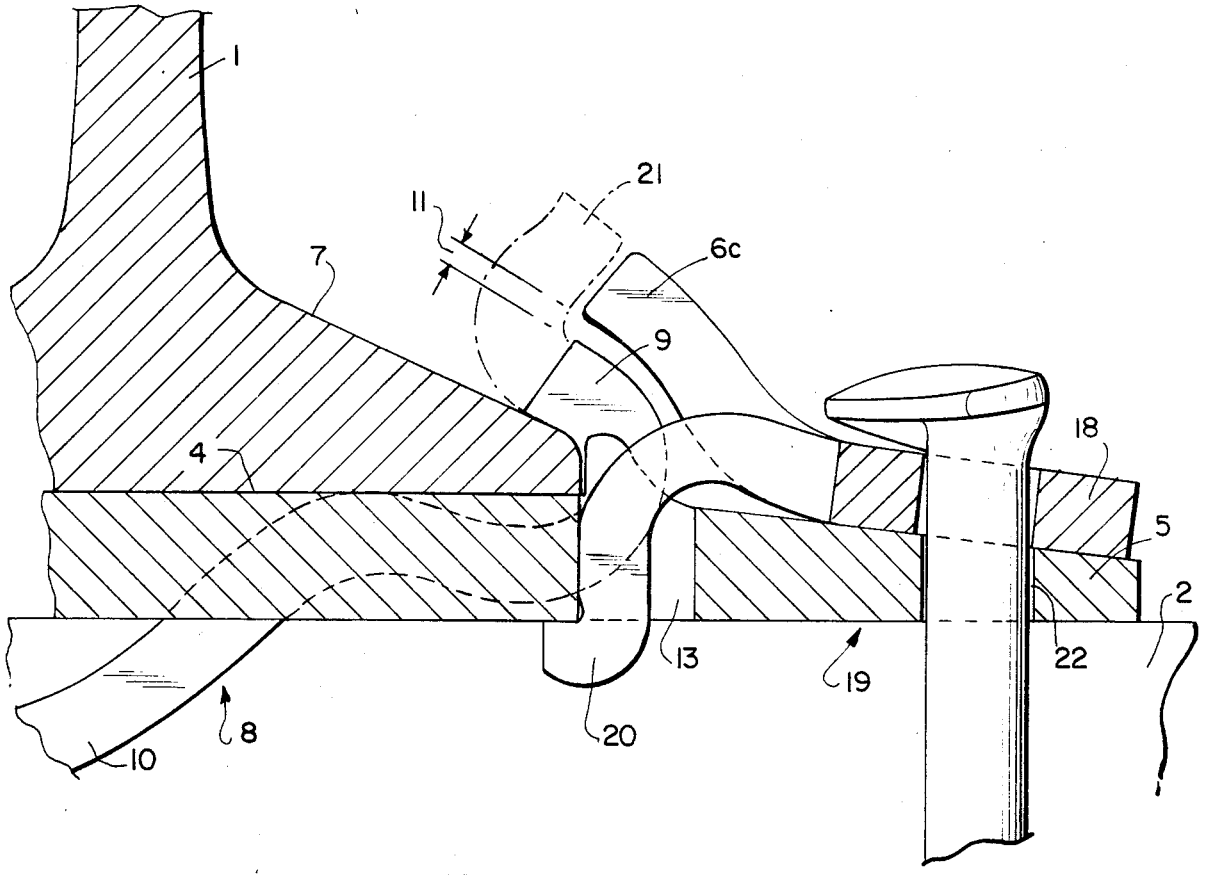
FIGS. 3 and 4 show a side view and a perspective view, respectively, of an anchor lock hook plate which is retrofitted to a standard tie plate.
Figure 4:
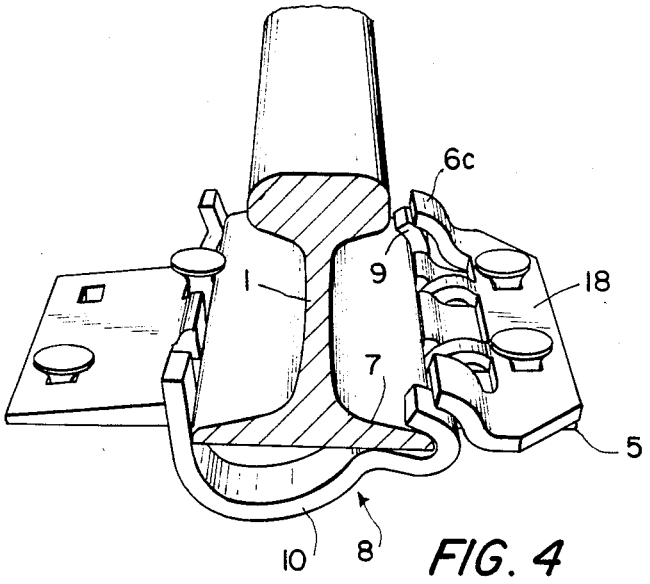
Figure 5:
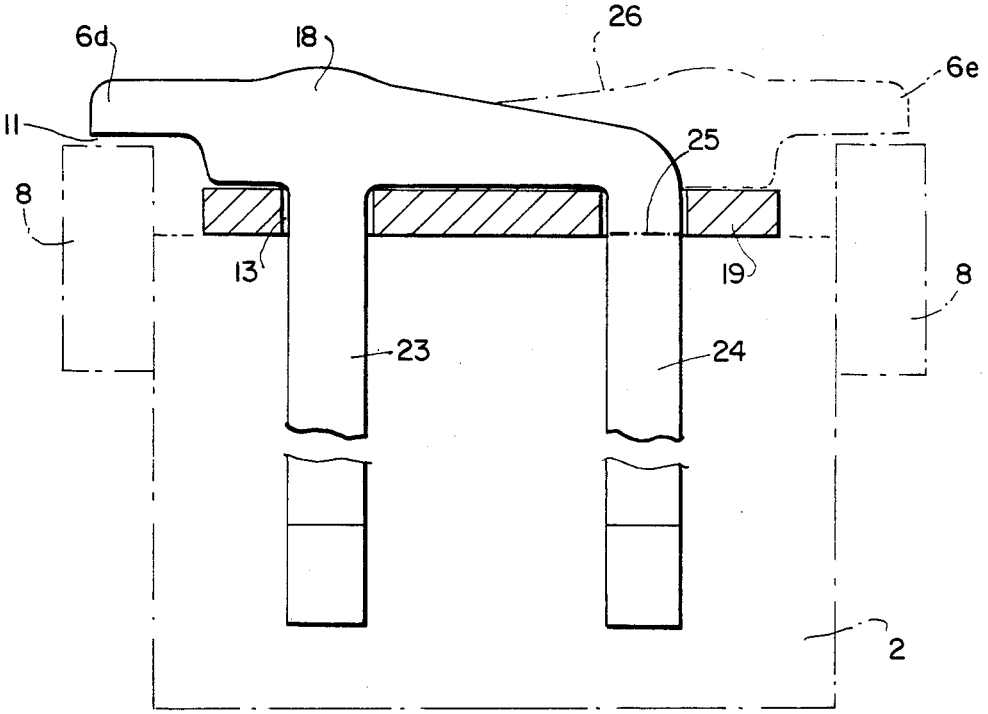
FIG. 5 shows a side view of another embodiment of a retrofitted anchor lock.

FIGS. 3 and 4 show an embodiment of the present invention wherein an anchor lock hook plate 18 is utilized for converting a standard tie plate 19 to an anchor lock plate. The standard tie plate 19 has a rail support central channel area 4 and a shoulder area 5 which extends from the rail support central channel area 4. A separate anchor lock hook plate 18 is fixed to at least one shoulder 5 of the tie plate 19 by a fastening means, for example, a spike 12, said anchor lock having at least one anchor engaging portion 6*c* which extends beyond the side of the railroad tie 2 and above the base of the rail 7. The anchor lock hook plate also has at least one tie plate engaging member 20 which extends through rail spike hole 13.

The embodiment of FIGS. 3 and 4 also show a rail anchor 8 of unitary construction containing a rail wedging portion 9 adapted to wedge the base of the rail which creates friction between the wedging portion 9 of the anchor and the base of the rail 7 which impedes longitudinal movement of the rail. The rail anchor 8 contains a tie contact portion 10 which takes leverage against the side of the railroad tie which activates the wedging action against the anchor. That portion of the wedge which extends beyond the edge of the base of the rail 7 is overlapped by the anchor lock 6*c* with a gap 11 disposed therebetween. The tie plate 19 contains existing rail spike holes 13 and plate securing holes 22. The tie plate engaging portion 20 of the anchor lock hook plate 18 extends through the rail spike holes 13 and engages with the bottom of the tie plate thus providing vertical restraint of the anchor lock. The anchor lock hook plate 18 is fixed to the shoulder of the tie plate 19 by spikes 12 which extend into the plate securing holes and the railroad tie whereby the lateral position of the anchor lock position is fixed. Alternatively, the wedge portion 9 of the rail anchor may be provided with an end portion 21 which is positioned against the end portion 6*c* of the anchor lock hook plate 18 thereby preventing rail rotation toward the anchor lock.

In another embodiment of the present invention, the anchor lock hook plate 18 can comprise at least one anchor engaging portion 6*d* and at least one spike portion 23. Advantageously, an additional spike portion 24 can be utilized in combination with spike portion 23 for adding lateral stability to the lock. The spike elements 23 and 24 can extend into the railroad tie to any desired depth or alternatively, to the depth shown by the dotted line 25. Phantom line 26 shows the optional use of a second lock 6*e*.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. An anchor lock plate for converting a tie plate to an anchor lock fastening assembly which comprises a tie plate having a rail support central channel area and shoulder areas which extend in opposite directions from the rail support central channel area a separate anchor lock plate fastened to at least one shoulder of said tie plate, said anchor lock plate having at least one anchor engaging portion which extends beyond the side of the tie and above the base of the rail, and at least one tie plate engaging portion which extends through the bottom of said tie plate, and a rail anchor of unitary construction containing a first portion adapted to wedge against the base of the rail and a second portion adapted to take leverage against the side of the tie, said rail anchor being overlapped by said anchor engaging portion outside the base edge of the rail with a small gap being maintained between said anchor and said anchor engaging portion.

2. The anchor lock plate of claim 1 wherein said anchor lock plate is fastened to said shoulder of said tie plate by spikes which extend into tie plate securing holes and the tie whereby the lateral position of said anchor lock plate is fixed.

3. The anchor lock plate of claim 1 wherein said tie plate engaging portion is formed as a hook which engages with a bottom surface of said tie plate and thus prevents said anchor lock plate from being pulled off said tie plate.

4. The anchor lock plate of claim 1 wherein one said tie plate engaging portion is formed as a spike which extends through a rail spike hole in the tie plate into the tie and a second portion is formed as a truncated spike which engages with the second rail spike hole thus assuring proper alignment of said anchor lock plate.

5. The anchor lock plate of claim 1 wherein said wedge portion of said rail anchor comprises an upset extension which is positioned against said anchor lock plate so as to prevent rail rotation toward said anchor lock plate in addition to said anchor lock plate's primary function of preventing rail rotation in the opposite direction.

* * * * *